United States Patent [19]

Echavarren et al.

[11] 4,179,763

[45] Dec. 25, 1979

[54] FOLDING BUNK BED UNIT

[76] Inventors: Luis A. Echavarren, 617 John Marshall Dr., NE., Vienna, Va. 22180; Daniel Echavarren, 7106 Catlett St., Springfield, Va. 22151

[21] Appl. No.: 918,460

[22] Filed: Jun. 23, 1978

[51] Int. Cl.[2] ..... A47C 17/40

[52] U.S. Cl. ..... 5/8; 5/9 B

[58] Field of Search ..... 5/8, 9, 11, 114; 108/115, 123; 312/194, 195

[56] References Cited

U.S. PATENT DOCUMENTS

| | | | |
|---|---|---|---|
| 2,945,241 | 7/1960 | Sideroff | 5/8 |
| 3,070,813 | 1/1963 | Nyman | 5/9 R |

FOREIGN PATENT DOCUMENTS

| | | | |
|---|---|---|---|
| 99885 | 5/1955 | Netherlands | 5/110 |

*Primary Examiner*—Casmir A. Nunberg

*Attorney, Agent, or Firm*—Lowe, King, Price & Becker

[57] ABSTRACT

A folding bunk bed unit comprises a top frame movable between a lower, folded position and an upper, unfolded position; a bottom frame; a plurality of struts each having a free upper end and a lower end pivotably attached to the bottom frame, said struts extending between the top and bottom frames when the top frame is in the unfolded position; and a plurality of link means interconnecting the top frame and the struts, said link means forming gussets for the unit in the unfolded position. Also disclosed is a method for elevating or lowering the unit.

12 Claims, 6 Drawing Figures

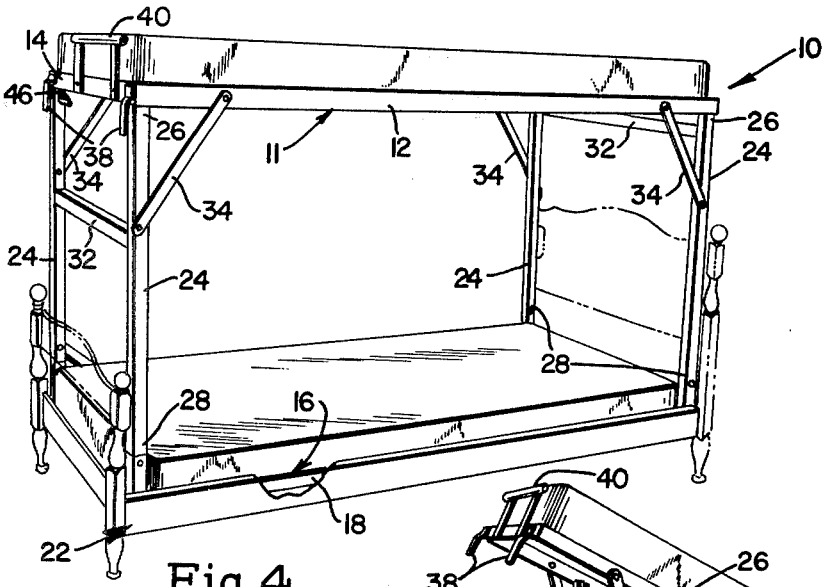
Fig. 4
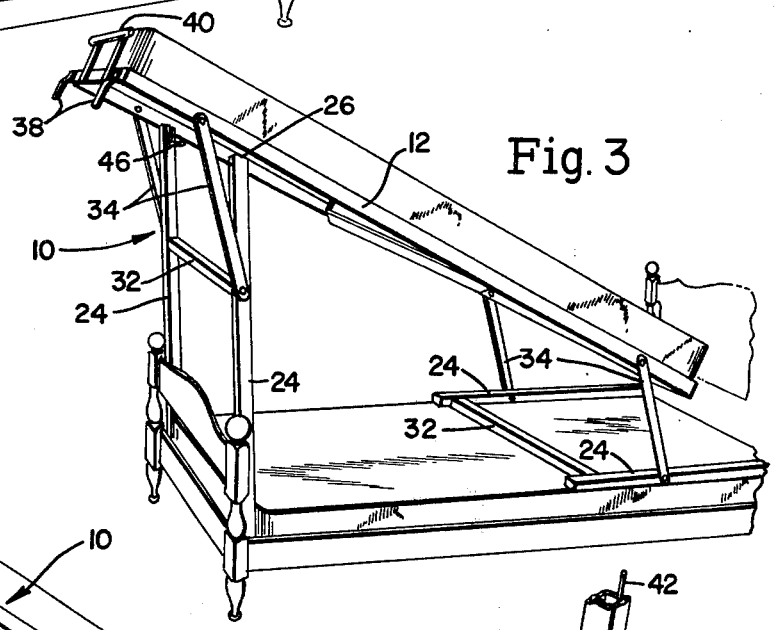
Fig. 3
Fig. 2
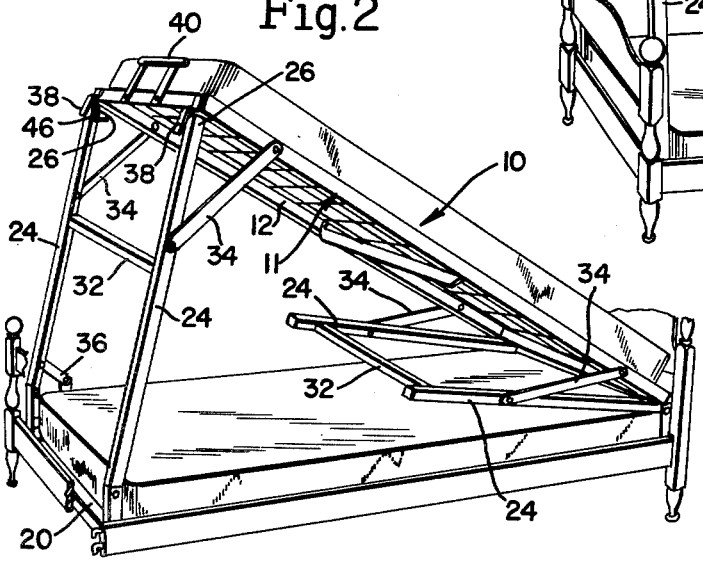
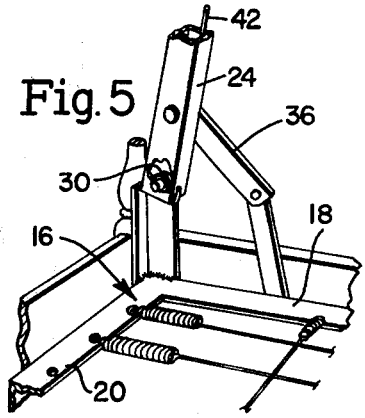
Fig. 5
Fig. 1
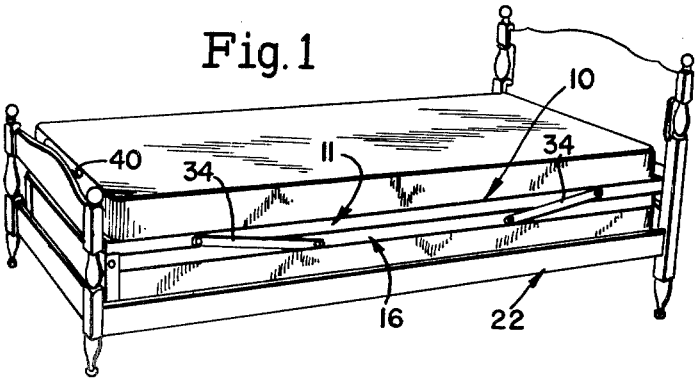
Fig. 6
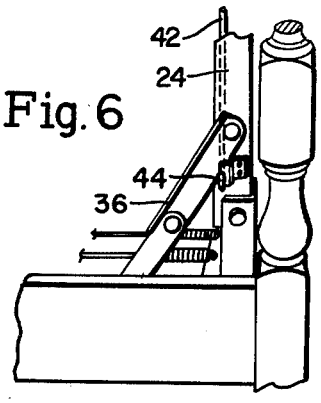

FOLDING BUNK BED UNIT

BACKGROUND OF THE INVENTION

1. Field of the Invention

This invention relates to a novel folding bunk bed unit and to a novel method for elevating or lowering a folding bunk bed unit. More particularly, the invention relates to a bunk bed unit which is easily elevated or lowered by one individual, which does not require any latches to be securely maintained in the elevated position, and which can be elevated or lowered in a minimum of space. Due to the minimum space required for elevating or lowering this unit, it is contemplated that the unit can be used in places of limited space such as trailers, trucks and boats, as well as at home.

2. Description of the Prior Art

Convertible bunk bed units are generally known in the art. U.S. Pat. No. 2,553,297 to Brumbaugh is illustrative of a convertible bunk bed which may be elevated or lowered in a minimum of space. U.S. Pat. No. 2,945,241 to Sideroff is illustrative of a convertible bunk bed having struts each of which is pivotably connected at one end to one bed frame with the other end moving and remaining in longitudinal tracks provided on the other bed frame, when the upper bunk is elevated or lowered. These bunk beds and other prior art bunk beds of which we are aware are deficient in that they cannot be used in conjunction with any standard bed frame, cannot be added to any bed without discarding existing furniture, cannot be used as a regular single bed when there is no need for an additional bed, are not easily operable by one person, are not operable in a minimum of space, require too many moving parts, or require latches to secure the upper bunk in the elevated position.

SUMMARY OF THE INVENTION

It is accordingly a primary object of this invention to provide a folding bunk bed unit that, being a bed in itself, can also be used in conjunction with any standard bed frame, thus maintaining the harmony of the existing bedroom decor.

Another object of the present invention is to provide a bunk bed unit that can be added to any bed without discarding existing furniture, thus avoiding the expenses of buying new furniture when an additional bed is necessary.

An additional object of the present invention is to provide a bunk bed unit that can be used as a regular single bed when there is no need for an additional bed, thus avoiding the annoyances that a fixed bunk bed causes when there is no need for it.

An even additional object of the present invention is to provide a folding bunk bed unit which is easily elevated or lowered by one person.

A further object of the present invention is to provide a folding bunk bed unit which can be elevated or lowered in a minimum of space and therefore is particularly suited for use in places of limited space such as trailers, trucks and boats.

A still further object of the present invention is to provide a folding bunk bed unit which requires a minimum of moving parts.

An even further object of the present invention is to provide a folding bunk bed unit which does not require latches to secure the upper bunk in the elevated position.

Other objects and advantages of the present invention will become apparent as the description thereof proceeds.

In satisfaction of the foregoing objects and advantages, there is provided by this invention a novel folding bunk bed unit which comprises a top frame movable between a lower, folded position and an upper, unfolded position, said top frame comprising parallel side rails and end rails; a bottom frame; a plurality of struts each having a free end and having an end which forms a pivotal connection with said bottom frame, said struts extending between said top and bottom frames when said top frame is in the unfolded position, and said free end being the upper end of said strut in the unfolded position; and a plurality of link means interconnecting said top frame and said struts, said link means forming gussets for said unit in the unfolded position.

Additionally, there is provided by this invention a novel method of folding a bunk bed unit which comprises a top frame movable between a lower, folded position and an upper, unfolded position, said top frame comprising parallel side rails and end rails; a bottom frame; a plurality of struts each having a free end and having an end which forms a pivotal connection with said bottom frame, said struts extending between said top and bottom frames when said top frame is in the unfolded position, and said free end being the upper end of said strut in the unfolded position; and a plurality of link means interconnecting said top frame and said struts, said link means forming gussets for said unit in the unfolded position; wherein the struts are in pairs with one pair being at each end of said unit; said method comprising the steps of (a) moving the free ends of one pair of struts immediately away from close relationship to the top frame; then (b) moving the pivoting links attached to the other pair of struts from a position which is inward with respect to these struts to a position which is outward with respect thereto; and then (c) moving the free ends of this other pair of struts in close relationship to the top frame until the top frame is completely lowered.

BRIEF DESCRIPTION OF THE INVENTION

Reference is hereby made to the accompanying drawings which form a part of the specification of the present invention.

FIGS. 1–4 are perspective views of one embodiment of the bunk bed unit of the present invention showing in sequence the unit being converted from a single bed to a double bed.

FIG. 1 is a perspective view of the unit in the folded position to function as a single bed.

FIG. 2 is a perspective view of one intermediate position as the unit is unfolded.

FIG. 3 is a perspective view of another intermediate position as the unit is unfolded.

FIG. 4 is a perspective view of the unit in the unfolded position to function as a double bunk bed.

FIGS. 5 and 6 are fragmentary magnified views from different perspectives of a corner of the unit at which the knee brace is located. FIG. 5 shows the knee brace in unlocked position and FIG. 6 shows the knee brace in locked position.

DETAILED DESCRIPTION OF THE INVENTION

Describing one embodiment of the present invention in detail, and referring to FIGS. 1–4, there is provided a folding bunk bed unit 10 having a movable top frame 11 which comprises parallel side rails 12 and end rails 14, and having a bottom frame 16 which comprises parallel side rails 18 and end rails 20. Bottom frame 16 is rigidly maintained in an elevated horizontal position by a supporting frame 22 which does not form any part of this invention. Each junction of a side rail and end rail forms a corner, and there is located at each corner of the bottom frame a strut 24. Each strut has a free upper end 26 and has a lower end 28 which is pivotally connected to bottom frame 16.

Referring now to FIG. 5, each of these pivotal connections is biased by a spring 30 which tends to swing the strut to a position perpendicular to the bottom frame. Although these springs are not necessary to the folding bunk bed unit of the present invention, it is preferable that they be employed since they minimize the effort required to elevate the top frame.

Referring back to FIGS. 1 to 4, the struts 24 are paired by lateral braces 32, with one pair of struts being at each end of unit 10. Lateral braces 32 permit each pair of struts to be moved in unison. The struts are interconnected to the top frame by link means 34. Link means 34 are pivotably connected between the top frame and the struts and serve a dual purpose. They minimize the friction and weight, thereby providing an easy and a smooth operation, and they function as gussets holding unit 10 square and steady once it is in the unfolded position. Although the folding bunk bed unit of the present invention could be constructed so that the free strut ends 26 physically contact the undersides of side rails 12 of the top frame upon elevating or lowering the top frame, such a construction is disadvantageous since it would result in friction and thereby decrease the ease of operation. Accordingly, it is preferred that there is not any physical contact between free strut ends 26 and the undersides of the side rails 12 of the top frame, when the top frame is elevated or lowered.

Preferably, there is provided at one end of folding bunk bed unit 10 a knee brace 36 (FIGS. 5 and 6) which pivotally interconnects one of struts 24 and bottom frame 16. Knee brace 36 is characterized by being pivotable between its ends. Although an additional knee brace may be used to interconnect bottom frame 16 and the paired strut or an unpaired strut, or although additional knee braces may be used to interconnect more than one of these other struts and bottom frame 16, no substantial advantage is thereby obtained. Knee brace 36 enables top frame 11 to be lowered one end at a time, with the pair of struts located at the end of bottom frame 16 opposite the knee brace end of unit 10 being lowered from the vertical position first. Thus, knee brace 36 permits one person to lower top frame 11 easily from its upper position.

Referring back to FIGS. 1–4, when knee brace 36 is used, it is preferable that there be provided a pair of downwardly oriented tabs 38 which are rigidly attached to the corners of end rail 14 at the knee brace end of unit 10. Tabs 38 have the function of preventing top frame 11 from moving to an inside position relative to struts 24 and thereby causing a jamming to occur, in the event top frame 11 is improperly lowered.

An additional preferable feature of folding bunk bed unit 10 is a handle 40 which is rigidly attached to one of the end rails 14 of top frame 11. When knee brace 36 is used in unit 10, handle 40 is located at the knee brace end thereof.

A further preferable feature of the present invention is a means which permits knee brace 36 to be remotely operated. One embodiment of such a means is a rod 42 having a U-shaped lower end 44 (FIG. 6) and an L-shaped upper end 46 (FIGS. 2–4). Advantageously, the length of rod 42 is located within the strut connected by the knee brace to the bottom frame, and ends 44 and 46 of rod 42 protrude outside the strut. Upper end 46 of the rod is located near the upper end of the strut to permit convenient simultaneous unlocking of knee brace 36 and folding of the pair of struts at that end. Specifically, knee brace 36 is remotely flexed upwardly by exerting an upward force on upper end 46 of rod 42 and the pair of struts at this end of the unit are simultaneously pushed inwardly and downwardly.

When top frame 11 is in the elevated position (FIG. 4), it is preferably lowered by moving one pair of struts 24 immediately away from close relationship to top frame 11; then moving pivoting links 34 attached to the other pair of struts 24 from a position which is inward with respect to said other struts to a position which is outward with respect thereto; and then moving free ends 26 of said other pair of struts 24 in close relationship to top frame 11 until top frame 11 is completely lowered. When knee brace 36 is used, the pair of struts located at the end of the unit opposite to knee brace 36 is moved first. Prior to or simultaneous with moving the other pair of struts, knee brace 36 is unlocked.

When top frame 11 is in the lowered position, it is preferably raised to the elevated position by the sequence set forth in FIGS. 1–4. It will be appreciated that top frame 11 could also be elevated by raising the two ends of top frame 11 simultaneously. This method is disadvantageous in that it requires a person at each end and considerable strength. An analogous method could be used for lowering top frame 11 but suffers from the same disadvantages.

As will be appreciated by one skilled in the art, there are many obvious modifications which can be made in the present invention without departing from the spirit thereof. Accordingly, the invention is not to be regarded as limited to the embodiment described above.

Having thus set forth and disclosed the nature of this invention, what is claimed is:

1. A folding bunk bed unit comprising a top frame movable between a lower, folded position and an upper, unfolded position, said top frame comprising parallel side rails and end rails; a bottom frame; a plurality of struts each having a free end and having an end which forms a pivotal connection with said bottom frame, said struts extending between said top and bottom frames when said top frame is in the unfolded position, and said free end being the upper end of said strut in the unfolded position and having a top surface that is separated from said top frame in the folded position; and a plurality of link means interconnecting said top frame and said struts, said link means forming gussets for said unit in the unfolded position.

2. The folding bunk bed unit of claim 1, wherein said link means are pivotably connected between said top frame and intermediate positions of said struts.

3. The folding bunk bed unit of claim 1, including a knee brace pivotally interconnecting a strut and the bottom frame.

4. The folding bunk bed unit of claim 3, including means for remotely operating the knee brace.

5. The folding bunk bed unit of claim 4, wherein the means for remotely operating the knee brace comprises a rod having a U-shaped lower end and having an L-shaped upper end.

6. The folding bunk bed unit of claim 5, wherein said rod is located within the strut to which the knee brace is attached, with said upper and lower ends of said rod protruding from said strut.

7. The folding bunk bed unit of claim 1, wherein said pivotal connection formed by each strut and the bottom frame is biased by a spring.

8. The folding bunk bed unit of claim 1, wherein a handle is rigidly attached to one of said end rails of said top frame.

9. The folding bunk bed unit of claim 1, wherein a pair of downwardly oriented tabs is rigidly attached to one of said end rails of said top frame.

10. A method of lowering the movable top frame of a folding bunk bed unit which comprises a top frame movable between a lower, folded position and an upper, unfolded position, said top frame comprising parallel side rails and end rails; a bottom frame; a plurality of struts each having a free end and having an end which forms a pivotal connection with said bottom frame, said struts extending between said top and bottom frames when said top frame is in the unfolded position, and said free end being the upper end of said strut in the unfolded position; and a plurality of link means interconnecting said top frame and said struts, said link means forming gussets for said unit in the unfolded position; wherein the struts are in pairs with one pair being at each end of said unit;

said method comprising the steps of:

(a) moving the free ends of one pair of struts immediately away from close relationship to the top frame; then (b) moving the pivoting links attached to the other pair of struts from a position which is inward with respect to said other struts to a position which is outward with respect thereto; and then (c) moving the free ends of said other pair of struts in close relationship to the top frame until the top frame is completely lowered.

11. The folding bunk bed unit of claim 1 wherein said free ends of said struts are separate from the side rails of said top frame during folding and unfolding of said unit.

12. The folding bunk bed unit of claim 1 wherein a single link means interconnects said top frame and each of said struts.

* * * * *